US009200823B2

(12) United States Patent
Boarman et al.

(10) Patent No.: US 9,200,823 B2
(45) Date of Patent: Dec. 1, 2015

(54) ICE MAKER WITH THERMOELECTRICALLY COOLED MOLD FOR PRODUCING SPHERICAL CLEAR ICE

(71) Applicant: Whirlpool Corporation, Benton Harbor, MI (US)

(72) Inventors: Patrick J. Boarman, Evansville, IN (US); Brian K. Culley, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 273 days.

(21) Appl. No.: 13/713,169

(22) Filed: Dec. 13, 2012

(65) Prior Publication Data

US 2014/0165599 A1 Jun. 19, 2014

(51) Int. Cl.

| | |
|---|---|
| ***F25B 21/02*** | (2006.01) |
| ***F25C 1/18*** | (2006.01) |
| ***F25C 1/22*** | (2006.01) |
| *F25D 11/00* | (2006.01) |

(52) U.S. Cl.

CPC . *F25C 1/18* (2013.01); *F25B 21/02* (2013.01); *F25C 1/22* (2013.01); *F25D 11/006* (2013.01)

(58) Field of Classification Search

CPC ..... F25C 1/18; F25C 1/22; F25C 5/04; F25C 5/08; F25C 5/182; F25C 2500/02; F25C 2305/022; F25C 2400/14; F25C 2500/06; F25C 1/10; F25C 1/225; F25B 21/02; F25D 11/006

USPC ..... 62/3.6, 3.63, 66, 71, 73, 344, 529, 356, 62/349–352, 530

See application file for complete search history.

(56) References Cited

U.S. PATENT DOCUMENTS

| | | | | |
|---|---|---|---|---|
| 3,172,269 | A | 3/1965 | Cole | |
| 3,192,726 | A | 7/1965 | Newton | |
| 3,200,600 | A | 8/1965 | Elfving | |
| 3,908,395 | A | 9/1975 | Hobbs | |
| 4,288,497 | A | 9/1981 | Tanaka et al. | |
| 4,402,185 | A * | 9/1983 | Perchak | 62/3.3 |
| 4,487,024 | A | 12/1984 | Fletcher | |
| 4,550,575 | A | 11/1985 | DeGaynor | |
| 4,727,720 | A | 3/1988 | Wernicki | |
| 4,910,974 | A | 3/1990 | Hara | |
| 5,618,463 | A * | 4/1997 | Rindler et al. | 249/92 |

(Continued)

FOREIGN PATENT DOCUMENTS

| | | |
|---|---|---|
| AU | 2006201786 | 11/2007 |
| CN | 1989379 | 6/2007 |

(Continued)

*Primary Examiner* — Cheryl J Tyler
*Assistant Examiner* — Jose O Class-Quinones

(57) ABSTRACT

An ice maker has a mold with a first piece and a second piece. A cavity within the mold includes a first reservoir in the first piece and a second reservoir in the second piece that align to substantially enclose the cavity. A fluid intake aperture in the first piece extends to the cavity for injecting water therein. A thermoelectric device has a cold side thermally coupled to the exterior surface of the second piece. The thermoelectric device transfers heat from the cold side to a hot side to provide a first temperature to the mold. A removable cooling source is thermally coupled to the hot side of the thermoelectric device. The cooling source is configured to reduce the temperature of the hot side to allow the cold side to provide a second temperature that is cooler than the first temperature to freeze the water in the cavity.

20 Claims, 8 Drawing Sheets

(56) References Cited

U.S. PATENT DOCUMENTS

| | | | | |
|---|---|---|---|---|
| 6,289,683 | B1 | 9/2001 | Daukas | |
| 6,820,433 | B2 | 11/2004 | Hwang | |
| 6,857,277 | B2 | 2/2005 | Somura | |
| 6,951,113 | B1 | 10/2005 | Adamski | |
| 7,131,280 | B2 | 11/2006 | Voglewede | |
| 7,210,298 | B2 | 5/2007 | Lin | |
| 7,448,863 | B2 | 11/2008 | Yang | |
| 7,669,435 | B2 | 3/2010 | Joshi | |
| 2004/0206250 | A1 | 10/2004 | Kondou | |
| 2006/0053805 | A1* | 3/2006 | Flinner et al. | 62/3.2 |
| 2007/0107447 | A1 | 5/2007 | Langlotz | |
| 2007/0193278 | A1* | 8/2007 | Polacek et al. | 62/3.2 |
| 2010/0055223 | A1 | 3/2010 | Kondou | |
| 2010/0218518 | A1 | 9/2010 | Ducharme | |
| 2010/0218540 | A1 | 9/2010 | McCollough | |
| 2010/0218542 | A1 | 9/2010 | McCollough | |
| 2010/0251730 | A1 | 10/2010 | Whillock | |
| 2012/0023996 | A1 | 2/2012 | Herrera | |
| 2012/0047918 | A1 | 3/2012 | Herrera | |

FOREIGN PATENT DOCUMENTS

| | | | |
|---|---|---|---|
| DE | 202006012499 | | 10/2006 |
| FR | 2771159 | | 5/1999 |
| GB | 2139337 | | 11/1984 |
| JP | 60141239 | | 7/1985 |
| JP | 1310277 | | 12/1989 |
| JP | 2031649 | | 2/1990 |
| JP | 4015069 | | 1/1992 |
| JP | 10253212 | A | 9/1998 |
| JP | 10253212 | A | 9/1998 |
| JP | 2001221545 | | 8/2001 |
| KR | 2001109256 | | 12/2001 |
| KR | 2006126156 | | 12/2006 |
| KR | 2011037609 | | 4/2011 |
| TW | 424878 | | 3/2001 |

* cited by examiner

ICE MAKER WITH THERMOELECTRICALLY COOLED MOLD FOR PRODUCING SPHERICAL CLEAR ICE

CROSS-REFERENCE TO RELATED APPLICATION

The present application is related to patent application Ser. No. 13/713,126, filed Dec. 13, 2012, entitled CLEAR ICE SPHERES, the entire contents of which are incorporated herein by reference.

FIELD OF THE INVENTION

The present invention generally relates to an ice maker for making ice with a thermoelectric device. More specifically, the invention relates to an ice maker for an appliance that is capable of making substantially clear ice with a thermoelectric device.

BACKGROUND OF THE INVENTION

During the ice making process when water is frozen to form ice, trapped air tends to make the resulting ice cloudy in appearance. The result is an ice cube that, when used in drinks, can provide an undesirable taste and appearance which distracts from the enjoyment of a beverage. Clear ice is significantly more desirable but requires processing techniques and structure which can be somewhat costly to efficiently include in consumer appliances.

SUMMARY OF THE INVENTION

According to one aspect of the present invention, an ice maker includes a mold that has a first piece and a second piece. A cavity within the mold includes a first reservoir in the first piece and a second reservoir in the second piece. The first and second reservoirs align to substantially enclose the cavity. A fluid intake aperture in the first piece extends from an exterior surface of the first piece to the cavity for injecting water. A thermoelectric device includes a cold side thermally coupled to the exterior surface of the second piece. The thermoelectric device transfers heat from the cold side to a hot side of the thermoelectric device to provide a first temperature to the mold. A removable cooling source is thermally and detachably coupled to the hot side of the thermoelectric device. The removable cooling source is configured to reduce the temperature of the hot side to allow the cold side to provide a second temperature that is cooler than the first temperature to freeze the water in the cavity.

According to yet another aspect of the present invention, an ice maker includes a mold that has a first piece and a second piece. A spherical cavity within the mold includes a first reservoir in the first piece and a second reservoir in the second piece. The first and second reservoirs align to substantially enclose the spherical cavity. A fluid intake aperture in the first piece extends from the exterior surface of the first piece to the spherical cavity for injecting water. A thermoelectric device includes a cold side thermally coupled to the exterior surface of the second piece to provide a first temperature to the mold and a hot side that receives heat transferred from the cold side. A cooling cartridge is thermally coupled to the hot side. The cooling cartridge is configured to reduce the temperature of the hot side to allow the cold side to provide a second temperature that is colder than the first temperature. The cooling cartridge is detachable and removable from the hot side by hand.

According to another aspect of the present invention, a method of making ice includes an ice mold that has an insulated piece, a metallic piece, and a cavity within the mold. The cavity has a first reservoir in the insulated piece and a second reservoir in the metallic piece, such that the first and second reservoirs align to substantially enclose the cavity. The metallic piece of the mold is cooled to a first temperature with a thermoelectric device that has a cold side thermally coupled to the exterior surface of the metallic piece. A hot side of the thermoelectric device is cooled with a removable cold source thermally and detachably coupled to the hot side. The removable cold source is configured to reduce the temperature of the hot side to allow the cold side to provide a second temperature that is cooler than the first temperature. Water is injected into the cavity through an inlet aperture in the first piece that extends from the exterior surface to the cavity. The water in the cavity is frozen to form an ice piece substantially occupying the volume of the cavity.

These and other features, advantages, and objects of the present invention will be further understood and appreciated by those skilled in the art by reference to the following specification, claims, and appended drawings.

DETAILED DESCRIPTION

Figure 1:
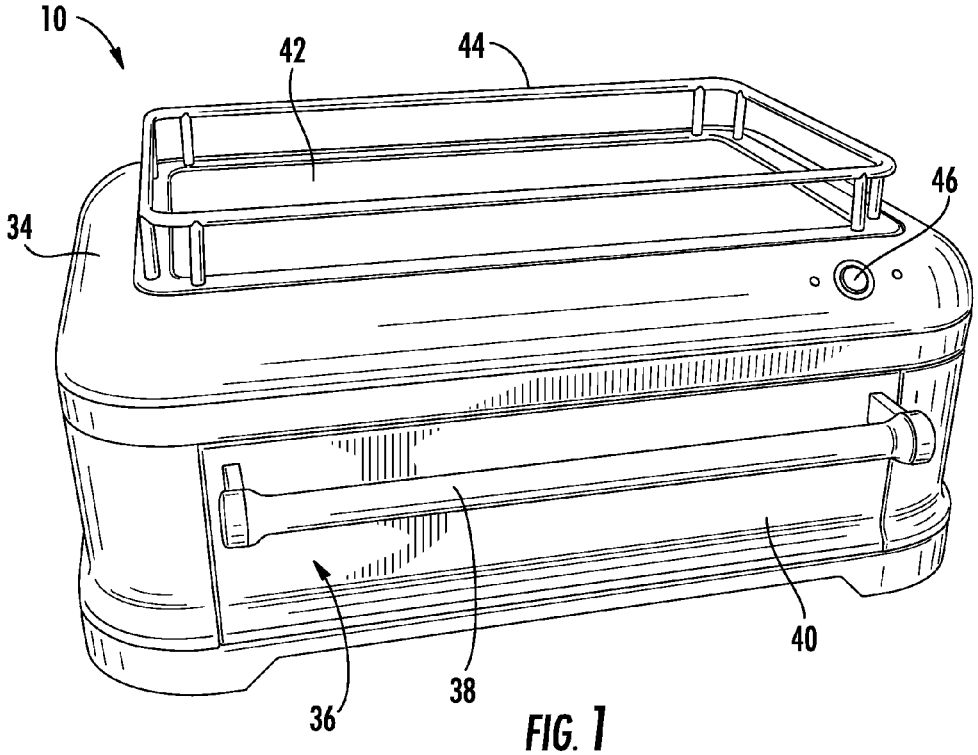
FIG. 1 is a front top perspective view of an ice maker of the present invention.

For purposes of description herein, the terms "upper," "lower," "right," "left," "rear," "front," "vertical," "horizontal," and derivates thereof shall relate to the customizable multi-stage fluid treatment assembly as oriented in FIG. 1. However, it is to be understood that the customizable multi-stage fluid treatment assembly may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIGS. 1-10, an ice maker is generally identified with the reference numeral 10. The ice maker 10 includes a mold 12 that has a first piece 14 and a second piece 16. A cavity 18 within the mold 12 has a first reservoir 20 in the first piece 14 and a second reservoir 22 in the second piece 16. The first and second reservoirs 20, 22 align to substantially enclose the cavity 18. A fluid intake aperture 24 in the first piece 14 extends from the exterior surface of first piece 14 to the cavity 18 for injecting water. A thermoelectric device 26 has a cold side 28 thermally coupled to the exterior surface of the second piece 16. The thermoelectric device 26 transfers heat from the cold side 28 to a hot side 30 of the thermoelectric device 26 to provide a first temperature to the mold 12. A removable cooling source 32 is thermally and detachably coupled to the hot side 30 of the thermoelectric device 26. The removable cooling source 32 is configured to reduce the temperature of the hot side 30 to allow the cold side 28 to provide a second temperature that is cooler than the first temperature to freeze the water in the cavity 18.

Referring now to the embodiment illustrated in FIG. 1, the ice maker 10 includes an exterior housing 34 having a substantially rectangular prism shape. The front side of the housing 34 includes a drawer 36 that has a handle 38 extending horizontally across a face portion 40 of the drawer 36. A top portion of the housing 34 includes a lid 42 disposed across a horizontal plane thereof. A railing 44 surrounds the lid 42 for containing bottles, glasses, beverage containers, or other items and objects to be contained when placed on the lid 42. Also, a push button 46 is disposed between the drawer 36 and the lid 42 on an upper edge portion of the housing 34 for actuating the ice maker 10.

Figure 2:
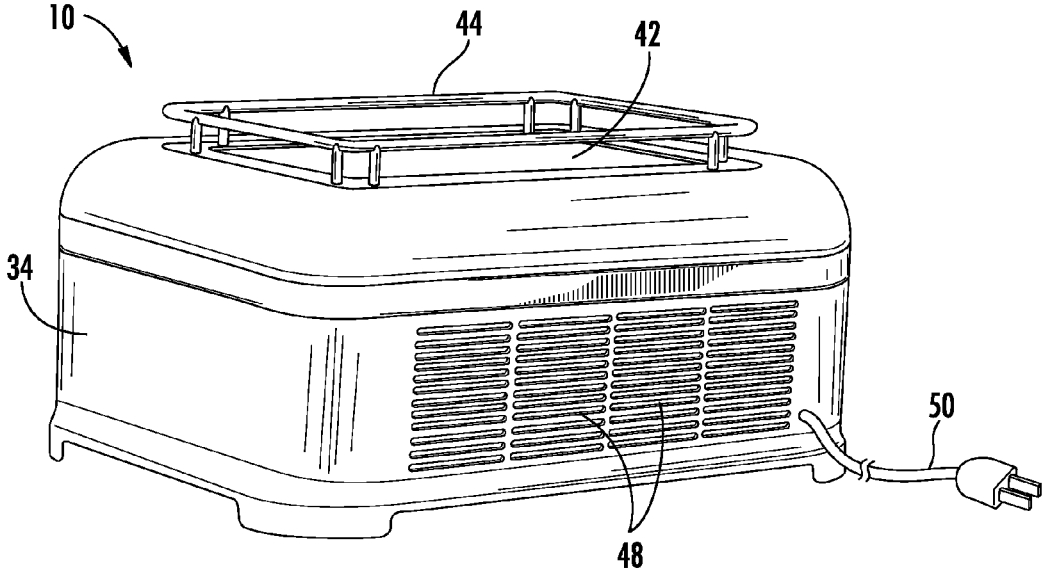
FIG. 2 is a rear top perspective view of the ice maker of FIG. 1.

As shown in FIG. 2, the rear portion of the housing 34 includes air vents 48 to provide ambient air circulation to the interior volume of the housing 34 for cooling electrical components or other portions of the ice maker 10. An energy source, comprising an electrical cord 50 that is adapted to connect with an electrical outlet, extends from the rear portion of the ice maker 10 proximate the air vents 48. It is contemplated that components of the exterior housing 34, including the lid 42 and the drawer 36, may be alternatively arranged on the exterior housing 34, combined together, or integrated as part of another appliance. It is also conceivable that the shape and configuration of the exterior housing 34 as illustrated in FIGS. 1 and 2 may include other shapes and configurations as one of ordinary skill in the art would appreciate.

Figure 3:
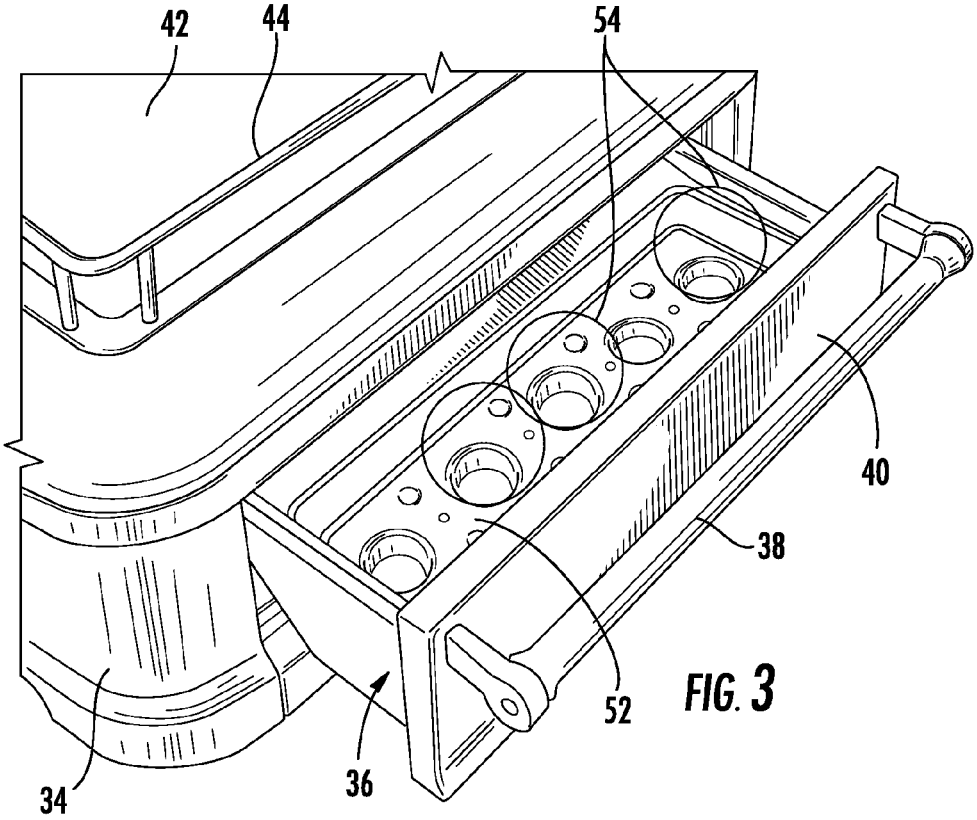
FIG. 3 is a top perspective view of the ice maker of FIG. 1 with a drawer in an open position.

As illustrated in FIG. 3, the drawer 36 is in an open position, laterally extending from the housing 34 to expose an ice presentation tray 52. The ice presentation tray 52 is horizontally positioned within the drawer and includes holes that are configured to hold ice pieces 54 formed by the ice maker 10. To move the drawer 36 to the open position, a force may be applied to the handle 38 to pull the drawer 36 outward and laterally displace the face portion 40 of the drawer 36 away from the housing 34. It is conceivable that other mechanisms may be configured to move the drawer 36 to the open position, such as an electrical drive body, a linkage arrangement, or other conceivable mechanisms.

Figure 4:
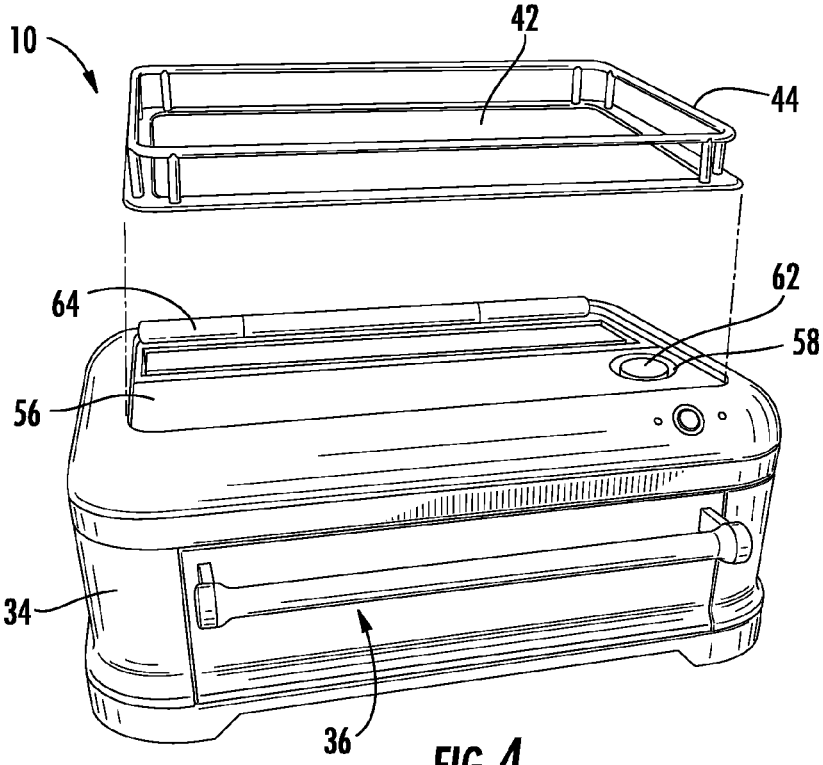
FIG. 4 is a top perspective view of the ice maker with a lid of the ice maker moved to a raised position.

The lid 42 may be raised and removed, as shown in FIG. 4, to expose a recessed area 56 of the upper portion of the housing 34. The recessed area 56 is formed to receive the lid 42 and, accordingly, is substantially planar in shape. An access aperture 58 is disposed on the recessed area 56 and extends to the interior area of the ice maker 10 enclosed by the housing 34. The access aperture 58 is positioned to align with a water tank 60 (FIG. 5) of the ice maker 10, such that water may be poured through the access aperture 58 into the water tank 60. A cap 62 is included within the access aperture 58 to fluidly seal the water tank 60. It is conceivable that the access aperture 58 may be located at an alternative position to align with the cooling source 32 or an alternatively located water tank 60, as described in more detail below. An access door 64 is also disposed on the recessed area and positioned above and aligned with the removable cooling source 32. The access door 64 is hingeably coupled with the recessed area 56, allowing the access door 64 to be pivoted open to access the interior area of the ice maker 10 within the housing 34 proximate the removable cooling source 32. It is also conceivable that the access door 64 may be alternatively shaped or configured to provide egress and ingress to other portions of the interior volume of the exterior housing 34 of the ice maker 10.

Figure 5:
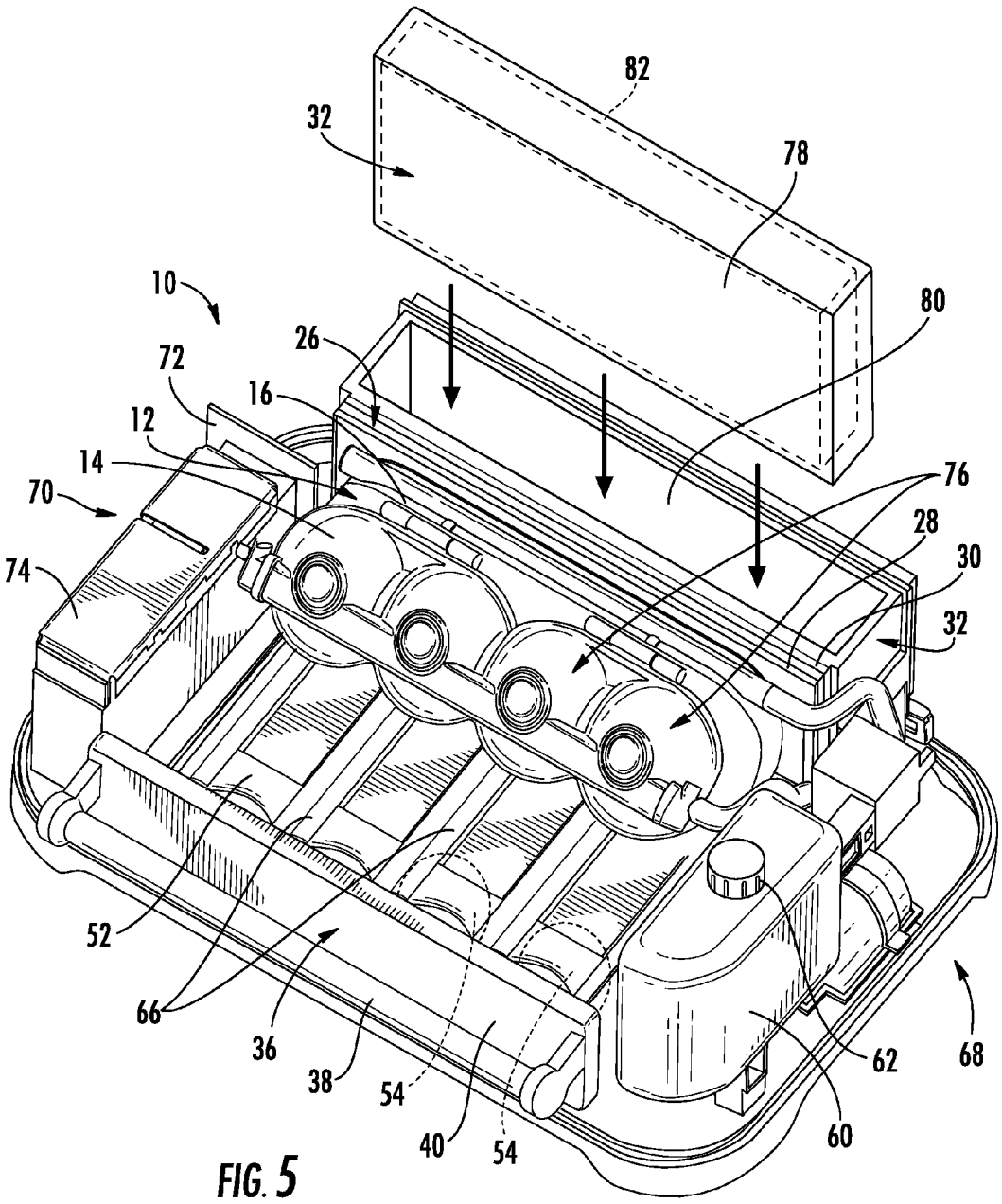
FIG. 5 is a top perspective view of the ice maker with the housing removed and the cartridge moved to a detached position.

Referring now to FIG. 5, the ice maker 10 is shown with the housing 34 substantially removed. As shown, the drawer 36 extends along the front portion of the ice maker 10 forward the ice presentation tray 52. The ice presentation tray 52 is positioned to receive ice pieces 54 along delivery tracks 66 that laterally extend from the ice presentation tray 52 to the ice mold 12. The delivery tracks 66 include a first track and a second track for opposing sides of each ice piece 54 that is delivered to the ice presentation tray 52. A first side 68 of the ice maker 10 includes the water tank 60 for receiving and storing water that is injected to the ice mold 12. A second side 70 of the ice maker 10 includes an electrical controller 72 and a power supply 74 to operate various devices within the ice maker 10. The electrical controller 72, power supply 74, electrical cord 50, and push button 46 are electrically connected, along with other devices, to operate the ice maker 10. It is contemplated that various components surrounding the mold 12 may be alternatively located and configured, such as the water tank 60, the power supply 74, and the electrical controller 72, among other components of the ice maker 10.

Figure 6:
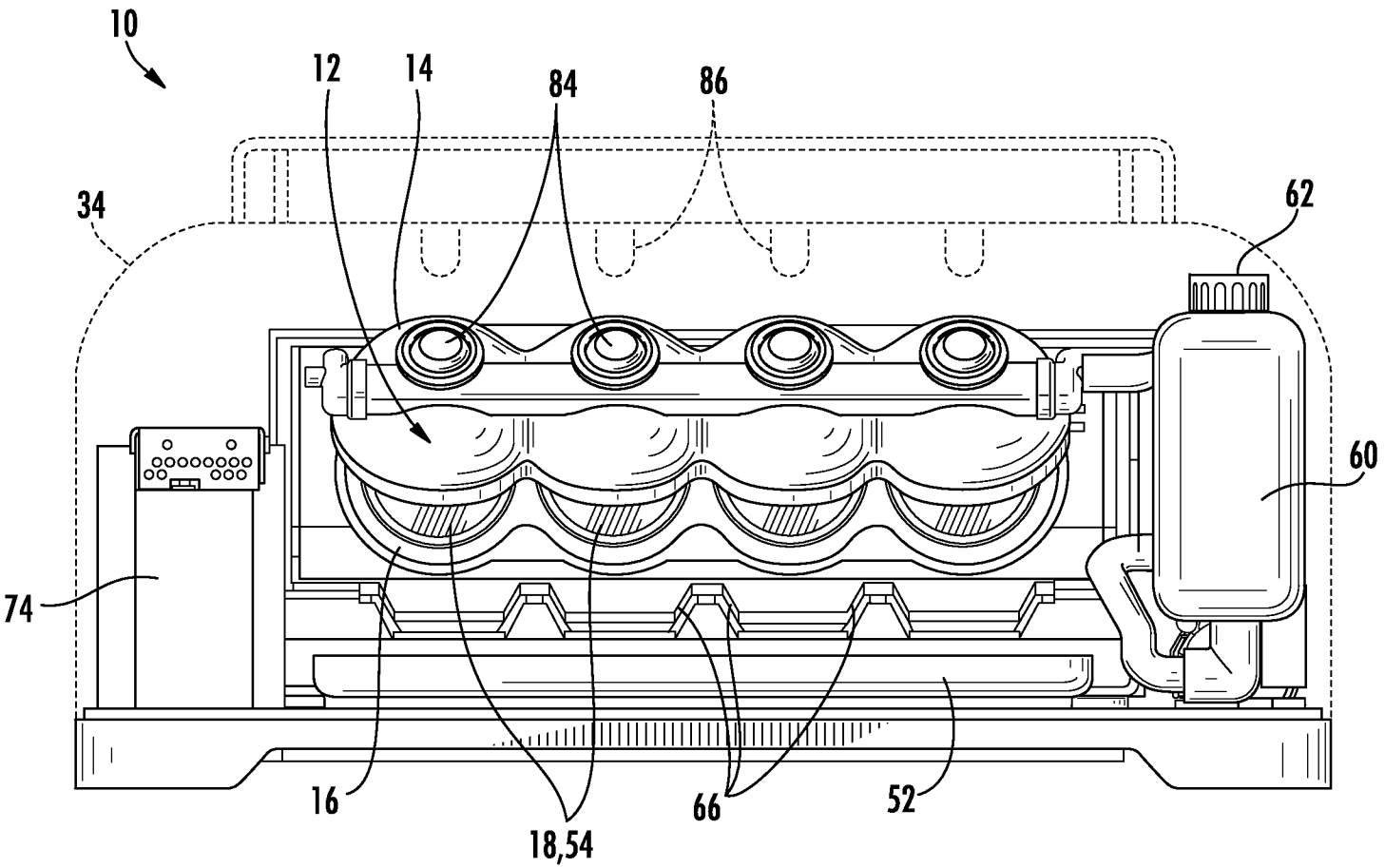
FIG. 6 is a front elevational view of the ice maker, showing the housing in dashed lines.

The ice mold 12, as shown in FIG. 5, includes four compartments 76, wherein each compartment 76 includes a cavity 18 (FIG. 6) to form a spherical ice piece 54. Each compartment 76 of the mold 12 also includes a first piece 14 and a second piece 16 that removably engage to align and substantially enclose the cavity 18 (FIG. 6). The first piece 14 of the mold 12 is positioned proximate the delivery tracks 66, facing the front side of the ice maker 10, such that the first piece 14 of the mold 12 may disengage from second piece 16 and pivot upward to release the ice piece 54 to the delivery tracks 66. The second piece 16 of the mold 12 is positioned to face the rear side of the ice maker 10 and thermally couple with the thermoelectric device 26. The cold side 28 of the thermoelectric device 26 couples with the exterior surface of the second piece 16. The thermoelectric device 26 transfers heat from the cold side 28 to the hot side 30, which is thermally coupled with the removable cooling source 32.

As also illustrated in FIG. 5, the removable cooling source 32, or cold source, includes a cartridge 78 that is shown removed and positioned above a receiving cavity 80 of the cooling source 32. The receiving cavity 80 is configured to slidably receive the cartridge 78 of the cooling source 32 and maintain thermal conductivity between the cartridge 78 and the interior surfaces of the receiving cavity 80. The removable cooling cartridge 78 includes a cooling material 82, such as a phase change material, that is thermally coupled with the hot side 30 of the thermoelectric device 26 and is configured to absorb heat from the hot side 30 of the thermoelectric device 26.

As shown in FIG. 6, the first piece 14 of the ice mold 12 disengages from the second piece 16 and pivots upward to release at least one ice piece 54 frozen in the cavity 18. Upon pivotally raising the first piece 14 of the ice mold 12, the spherical cavity 18 within the ice mold 12 is exposed which contains the frozen ice piece 54. An ejector pin 84 is disposed on each first piece 14 of each ice mold 12 and is configured to release the ice piece 54 from an interface between the ice piece 54 and the interior surface of the first reservoir 20 (FIG. 8) of the cavity 18. The ejector pins 84 are positioned to abut fingers 86 protruding down from the housing 34 into the interior volume of the housing 34 when the first piece 14 of the ice mold 12 pivots upward. As such, the fingers 86 actuate the ejector pin 84 and release the ice piece 54 contained within the cavity 18 to the delivery tracks 66. It is contemplated that the cavity 18 may be alternatively shaped to form various shaped ice pieces 54, such as cubes, that may similarly be released to the delivery tracks 66 and slid to the ice presentation tray 52.

Figure 7:
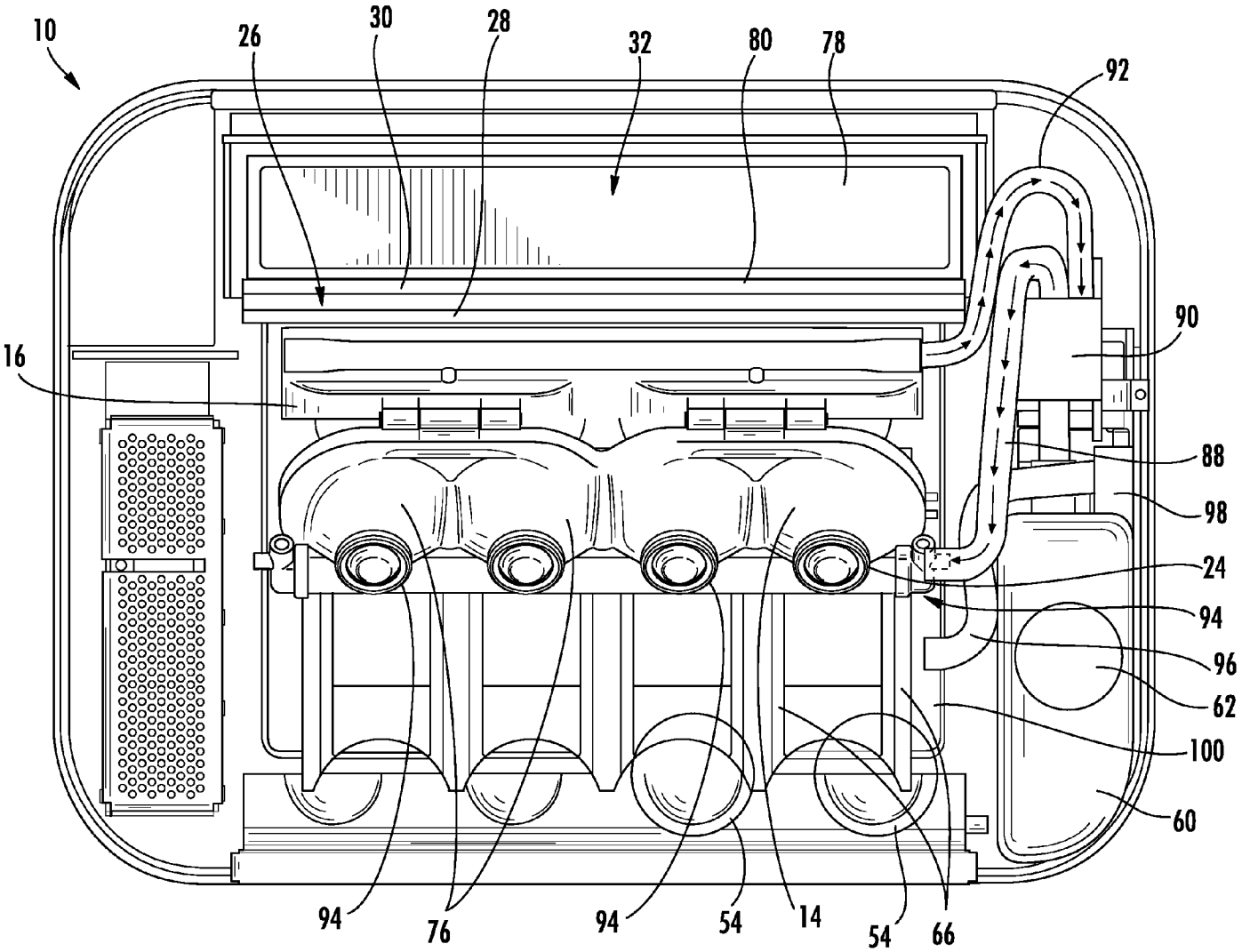
FIG. 7 is a top plan view of the ice maker with the mold in an open position.
Figure 8:
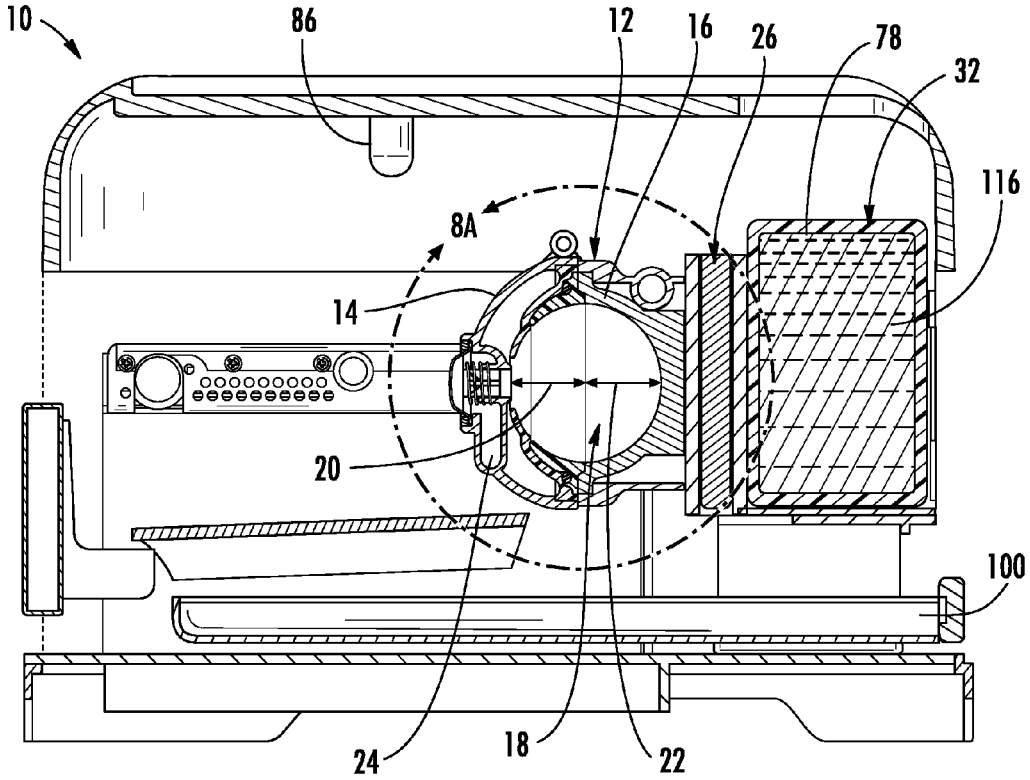
FIG. 8 is a cross-sectional side view of an the ice maker along a cavity of the mold.

A water delivery line 88, as illustrated in FIG. 7, extends from the water tank 60 and a water pump 90 coupled to the water tank 60 to fluidly couple with the fluid intake aperture 24 in the first piece 14 of the ice mold 12. The fluid intake aperture 24 extends from the exterior surface of the first piece 14 to the cavity 18 of the ice mold 12 for injecting water into the cavity 18 (FIG. 8). A return line 92 also extends from the water pump 90 to couple with the first piece 14 of the ice mold 12 to complete a water circuit, as described in more detail below. The removable cooling source 32 includes a substantially rectangular shape and extends along the hot side 30 of the thermoelectric device 26 that is positioned to thermally couple with the second piece 16 of the molds 12 all four compartments 76 of the ice maker 10. As illustrated, the hot side 30 of the thermoelectric device 26 abuts the receiving cavity 80 of the removable cooling source 32. Accordingly, the removable cartridge 78 of the cooling source 32 also abuts the receiving cavity 80 to effectuate a substantial thermal connection between the hot side 30 of the thermoelectric device 26 and the cooling source 32. It is also conceivable that the interior surface of the cavity 18 may be designed to include the hot side 30 of the thermoelectric device 26, such that direct contact is made between the removable cooling source 32 and the thermoelectric device 26. Accordingly, the thermoelectric device 26 transfers heat from the cold side 28 to the hot side 30 to provide a first temperature to the mold 12. The cooling source 32 is configured to reduce the temperature of the hot side 30 to allow the cold side 28 to provide a second temperature that is colder than the first temperature to freeze water in the cavity 18. Electrical current supplied to the thermoelectric device 26 may conceivably be reversed to alternately transfer heat from the hot side 30 to the cold side 28, which may be done to release the interface between the mold 12 and the ice piece 54 therein.

As also illustrated in FIG. 7, the water delivery line 88 includes an outlet 94 that couples with each compartment 76 of the ice maker, such that the water tank 60 couples with the each compartment 76 in parallel. It is conceivable that the water tank 60 may also be connected with the cavities 18 in series. When water is being injected into the cavity 18, an amount of water that is not frozen within the cavity 18 is dispensed from the cavity 18 to the return water line 92. The return water line 92 extends from each cavity 18 to the water pump 90 to return the water to the water delivery line 88. It is conceivable that the return line 92 may alternatively extend back to the water tank 60. A drain line 96 extends from a drain basin 98 to an evaporation tray 100 that extends below the delivery tracks 66 and other portions of the ice maker 10. The evaporation tray 100 is configured to receive water dispensed from the drain basin 98 and evaporate the water or store the water for a user to later remove the evaporation tray 100 and dispense the water therein. The drain basin 98 is configured to receive waste water from the water pump 90 or other portions of the water circuit.

Figure 8A:
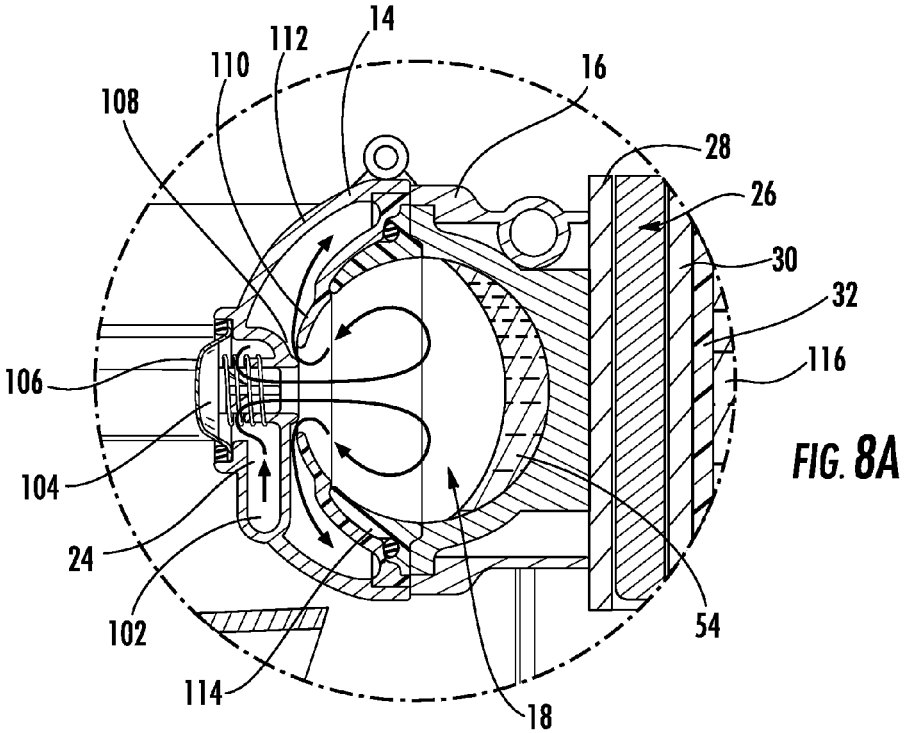
FIG. 8A is an enlarged cross-sectional side view of an the ice maker taken at line 8A of FIG. 8, showing the water stream in the cavity.

As shown in FIGS. 8-8A, each compartment 76 of the mold 12 includes a first piece 14 and a second piece 16 that removably engage to align a first reservoir 20 and a second reservoir 22 of the cavity 18, substantially enclosing the cavity 18. As illustrated, a cross section of the mold 12 is being injected with water from the water delivery line 88 (FIG. 7). Water is injected through the fluid intake aperture 24 in the first piece 14 of the mold and is received within the spherical cavity 18. The fluid intake aperture 24 includes a lower portion 102 where the water is first received and an upper portion 104 that directs the water into the cavity 18. The upper portion 104 is enclosed on one side by a diaphragm 106 of the ejector pin 84 and configured to direct the water around the pin portion of ejector pin 84 into the cavity 18. Upon injection into the cavity 18, the water stream flows radially outward from the accumulating ice piece and is captured by an outlet 108, as shown in FIG. 8A. The outlet 108 surrounds the upper portion of the fluid intake aperture 24, proximate the pin portion of the ejector pin 84, such that water leaves the cavity 18 via the outlet 108. After leaving the cavity 18, the water stream is collected between a water jacket portion 110 of the first piece 14 of the mold 12 and an exterior portion 112 of the first piece 14. The water jacket 110 is comprised of a polymeric material that couples with a metallic insert 114 to form the interior surface of the first reservoir 20. The space between the water jacket 110 and the exterior portion 112 dispenses the water stream to the water return line 92 (FIG. 7), as described above. It is contemplated that the intake aperture 24 and outlet 108 may be alternatively configured, along with other various components of the mold 12.

The removable cooling source 32, as shown in FIGS. 8-8A, is shown thermally coupled with the hot side 30 of the thermoelectric device 26. The cross section of the removable cooling source 32 shows a phase change material 116 contained within the cooling source 32. The phase change material 116 may include water or other phase change liquids, a refrigerant gel, a refrigerant liquid, or other conceivable cooling materials. The removable cooling source 32 and the thermoelectric device 26 are together configured to draw less than fifteen amperes and to create a temperature difference at least fifteen degrees Fahrenheit between the cold side 28 of the thermoelectric device 26 and the first piece 14 of the mold 12. Such temperature difference is configured to create a substantially clear ice piece 54 within the cavity 18. Substantially clear ice pieces 54 contain very few, if any, visible gas pockets frozen in the ice piece, resulting in a substantially transparent ice piece.

Still referring to FIGS. 8-8A, the cartridge 78 of the removable cooling source 32 can be detachably removed by hand without the use of tools, such that the cooling material 116 within the cartridge 78 may be chilled or frozen in an auxiliary freezer chamber. Accordingly, the removable cooling source 32 is pre-cooled by detachably removing the cartridge 78 and inserting the cartridge 78 in an auxiliary freezer chamber to cool the cooling material 116. The cartridge 78 is then inserted into the cavity 80 (FIG. 5) to regain a thermal coupling with the thermoelectric device 26 before the ice maker 10 is actuated to begin to make ice. Further, it is conceivable that multiple cartridges 78 may be stored in the auxiliary freezer chamber, whereby the cartridges 78 may be selectively removed from the freezer chamber and inserted into the receiving cavity 80 when ice making is desired.

Figure 9:
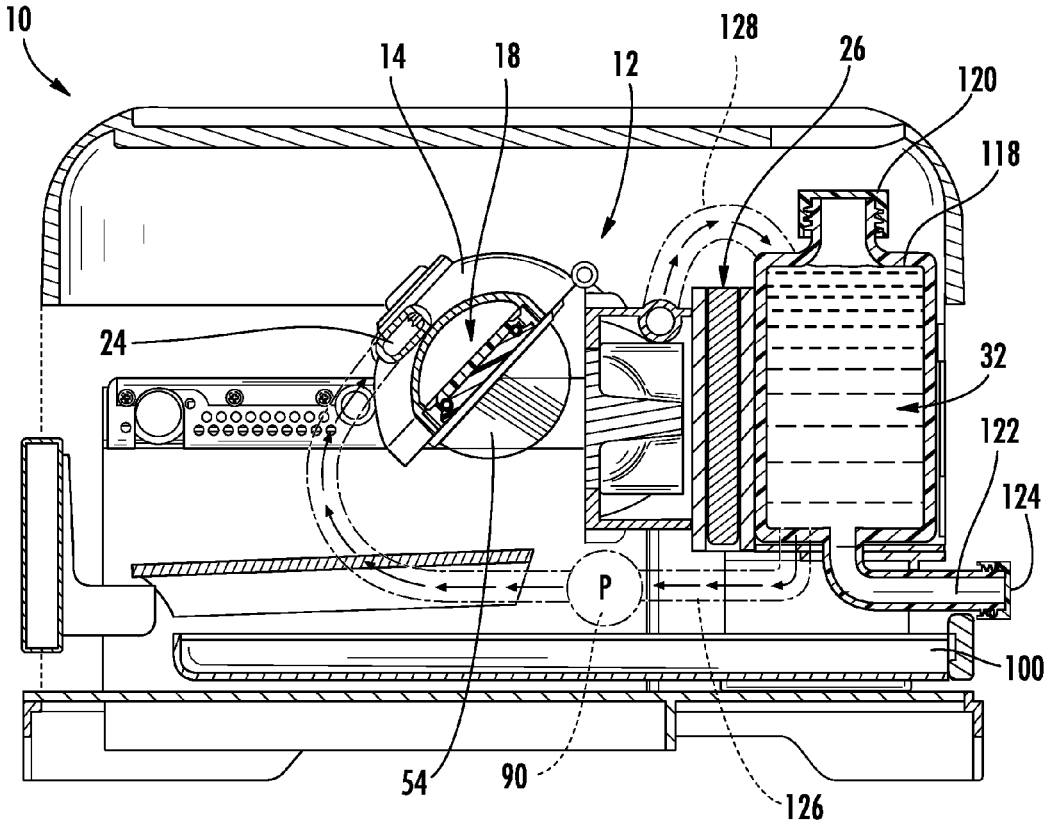
FIG. 9; is a cross-sectional side view of the additional embodiment of the ice maker, showing the cold source having a water basin.
Figure 10:
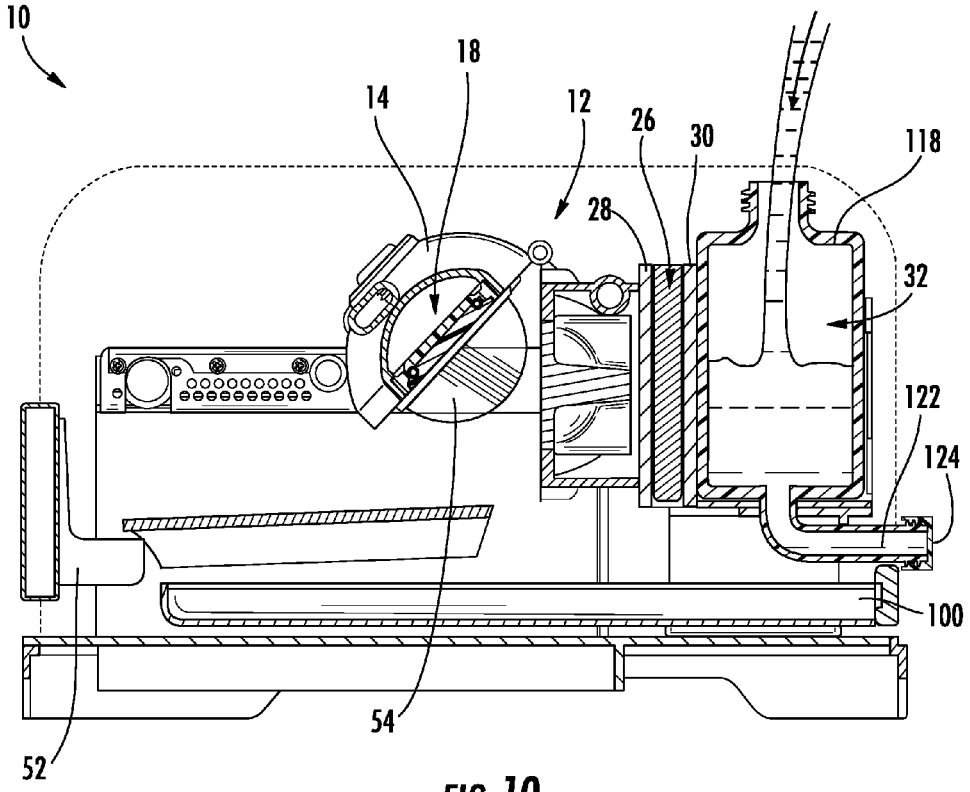
FIG. 10 is a cross-sectional side view of the additional embodiment of FIG. 9 with fluid being poured into the water basin.

An additional embodiment of the ice maker 10 is illustrated in FIG. 9, showing the cooling source 32, or cold source, comprising a water basin 118 thermally coupled with the hot side 30 of the thermoelectric device 26. The water basin 118 includes a cover 120 at an upper portion of the water basin 118 for pouring cold water or other cold liquid into the water basin, as shown in FIG. 10. The cover 120 is threadably engaged with the upper portion of the water basin 118, and may conceivable be coupled in alternative arrangements. A discharge drain 122 is coupled with a lower portion of the water basin 118 to release water or other liquid contained within the water basin 118. The discharge drain 122 includes a cap 124 enclosing an exterior portion of the discharge drain 122, which may also be threadably coupled therewith. It is contemplated that the water basin 118 may replace the water tank 60, as shown in FIG. 5, that is used in the water cycle to deliver water to the cavity 18. Accordingly, in such an embodiment, a water intake line 126, shown in dashed lines, may be coupled with the lower portion of the water basin 118 to deliver water to the water pump 90 and to the fluid intake aperture 24 in the first piece 14 of the mold 12. A water return line 128 may also then be fluidly coupled with the water basin 118 or the water pump 90 to receive the water stream exiting the cavity 18.

When water or fluid within the water basin 118, as shown in FIG. 10, reaches a temperature above a select threshold, the user is indicated to remove the cap 124 enclosing the discharge drain 122 to empty water contained within the water basin 118 and refill the water basin 118 with a colder liquid, such as ice water. In addition, when the water or fluid in the water basin 118 is used to fill the cavity 18, the user is notified when the water level is low, such as not enough water to refill the cavity 18, and is instructed to refill the water basin 118, as shown in FIG. 10. Similar to the other cooling source 32 embodiment, the water basin 118 is configured to allow the thermoelectric device 26 to draw less than fifteen amperes to create a difference of at least fifteen degrees Fahrenheit between the cold side 28 and the first piece 14 of the mold 12, thereby allowing a substantially clear ice piece 54 to be formed within the cavity 18. It is conceivable that upon forming the substantially spherical ice pieces 54, the ice pieces 54 may melt in the ice presentation tray 52 to a size that is unacceptable for a consumer beverage but may be sized to be received within the water basin 118 to maintain a cool water temperature within the water basin 118.

It will be understood by one having ordinary skill in the art that construction of the described invention and other components is not limited to any specific material. Other exemplary embodiments of the invention disclosed herein may be formed from a wide variety of materials, unless described otherwise herein. In this specification and the amended claims, the singular forms "a," "an," and "the" include plural reference unless the context clearly dictates otherwise.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An ice maker for making substantially clear ice pieces, the ice maker comprising:

a mold that has a first piece and a second piece;

at least one cavity within the mold having a first reservoir in the first piece and a second reservoir in the second piece, wherein the first and second reservoirs align to substantially enclose the at least one cavity;

a fluid intake aperture in the first piece that extends from an exterior surface of the first piece to the at least one cavity for injecting water;

a thermoelectric device with a cold side thermally coupled to an exterior surface of the second piece, wherein the thermoelectric device transfers heat from the cold side to a hot side of the thermoelectric device to provide a first temperature to the mold;

a removable cooling source thermally and detachably coupled to the hot side of the thermoelectric device, wherein the cooling source is configured to reduce the temperature of the hot side to allow the cold side to provide a second temperature that is cooler than the first temperature to freeze the water in the at least one cavity; wherein water in the at least one cavity at the second temperature forms an ice piece that substantially occupies a respective volume of the at least one cavity where said ice piece is formed; and water leaving the at least one cavity is collected between a water jacket portion of the first piece of the mold and an exterior portion of the first piece of the mold; and wherein the water jacket portion forms an interior surface of the first reservoir.

2. The ice maker of claim 1, wherein the cooling source is a select one of a cold water basin and a removable frozen cartridge.

3. The ice maker of claim 1, wherein the cooling source includes a phase change material and is configured to be removable by hand, such that the cooling source can be detachably removed and the phase change material cooled.

4. The ice maker of claim 1, wherein the cooling source is configured to absorb heat from the hot side of the thermoelectric device, and wherein the mold and the thermoelectric device are configured to make a substantially clear ice piece.

5. The ice maker of claim 1, wherein the first piece is pivotally coupled with the second piece, and wherein the first piece pivots away from the second piece to expose the at least one cavity to release an ice piece formed therein.

6. The ice maker of claim 1, further comprising: a water line coupled with the fluid intake aperture to inject water into the at least one cavity.

7. The ice maker of claim 1, further comprising: a water line having an outlet coupled with the fluid intake aperture to inject water into the at least one cavity and an intake coupled with the cooling source, wherein the cooling source includes a cold water basin.

8. An ice maker for making substantially clear ice pieces, the ice maker comprising:

a mold that has a first piece and a second piece;

at least one spherical cavity within the mold having a first reservoir in the first piece and a second reservoir in the second piece, wherein the first and second reservoirs align to substantially enclose the at least one spherical cavity;

a fluid intake aperture in the first piece that extends from an exterior surface of the first piece to the at least one spherical cavity for injecting water;

a thermoelectric device having a cold side thermally coupled to an exterior surface of the second piece to provide a first temperature to the mold and a hot side of the thermoelectric device that receives heat from the cold side; and a cooling cartridge thermally coupled to the hot side of the thermoelectric device, wherein the cooling cartridge is configured to reduce the temperature of the hot side to allow the cold side to provide a second temperature that is colder than the first temperature; and wherein the cooling cartridge is detachable and removable by hand; wherein water in the at least one spherical cavity at the second temperature forms an ice piece that substantially occupies a respective volume of the at least one spherical cavity where said ice piece is formed; and water leaving the at least one spherical cavity is collected between a water jacket portion of the first piece of the mold and an exterior portion of the first piece of the mold; and wherein the water jacket portion forms an interior surface of the first reservoir.

9. The ice maker of claim 8, wherein the water jacket portion is comprised of a polymeric material that couples with a metallic insert to form the interior surface of the first reservoir.

10. The ice maker of claim 8, wherein the cooling cartridge includes a phase change material, such that the cooling cartridge can be detachably removed and the phase change material cooled in an auxiliary freezer chamber.

11. The ice maker of claim 8, wherein the thermoelectric device is configured to draw less than 15 amps to create temperature difference of at least 15 degrees between the cold side and the first piece of the mold to create a substantially clear ice piece in the at least one spherical cavity.

12. The ice maker of claim 8, further comprising: a water line coupled with the fluid intake aperture to inject water into the at least one spherical cavity.

13. The ice maker of claim 8, further comprising: a water line having an outlet coupled with the fluid intake aperture to inject water into the at least one spherical cavity and an inlet coupled with the cooling source, wherein the cooling source includes a cold water basin.

14. A method of making substantially clear ice pieces, the method comprising:

providing an ice mold that includes an insulated piece, a metallic piece, and at least one cavity within the mold having a first reservoir in the insulated piece and a second reservoir in the metallic piece, wherein the first and second reservoirs align to substantially enclose the at least one cavity;

cooling the metallic piece of the mold with a thermoelectric device having a cold side thermally coupled to an exterior surface of the metallic piece to a first temperature;

cooling a hot side of the thermoelectric device with a removable cold source thermally and detachably coupled to the hot side, wherein the cold source is configured to reduce the temperature of the hot side of the thermoelectric device to allow the cold side to provide a second temperature that is cooler than the first temperature;

injecting water into the at least one cavity through an inlet aperture in the insulated piece that extends from an exterior surface of the insulated piece to the at least one cavity; and freezing the water in the at least one cavity at the second temperature to form an ice piece substantially occupying a respective volume of the at least one cavity where said ice piece is formed; wherein water leaving the cavity is collected between a water jacket portion of the insulated piece of the mold and an exterior portion of the insulated piece of the mold; and wherein the water jacket portion forms an interior surface of the first reservoir.

15. The method of claim 14, further comprising:

dispensing water that is injected into the at least one cavity through an outlet aperture in the insulated piece that extends from the exterior surface of the insulated piece to the at least one cavity, wherein water is simultaneously injected in and dispensed from the at least one cavity as the water is freezing in the at least one cavity.

16. The method of claim 15, wherein the method is configured to form a substantially clear ice piece in the at least one cavity.

17. The method of claim 14, wherein the cold source includes a cartridge that is removable by hand without tools and has a phase change material.

18. The method of claim 17, further comprising:

pre-cooling the cold source by detaching and removing the cartridge and inserting the cartridge in an auxiliary freezer chamber to cool the phase change material.

19. The method of claim 14, wherein the thermoelectric device is configured to draw less than 15 amps to create temperature difference of at least 15 degrees between the cold side and the insulated piece of the mold to create a substantially clear ice piece in the at least one cavity.

20. The method of claim 14, wherein the step of injecting water into the at least one cavity includes supplying water to the inlet aperture through a water line coupled with the fluid intake aperture.

* * * * *